United States Patent [19]

Faulkner

[11] 4,179,970

[45] Dec. 25, 1979

[54] AUTOMATIC ARPEGGIO FOR MULTIPLEXED KEYBOARD

[76] Inventor: Alfred H. Faulkner, 1324 Portesuello Ave., Santa Barbara, Calif. 93105

[21] Appl. No.: 808,768

[22] Filed: Jun. 22, 1977

[51] Int. Cl.[2] ..... G10F 1/00; G10H 1/02

[52] U.S. Cl. ..... 84/1.03; 84/1.24

[58] Field of Search ..... 84/1.01, 1.03, 1.24, 84/1.27, DIG. 22, DIG. 23

[56] References Cited

U.S. PATENT DOCUMENTS

| | | | |
|---|---|---|---|
| 3,842,184 | 10/1974 | Kniepkamp et al. | 84/DIG. 22 |
| 3,854,366 | 12/1974 | Deutsch | 84/1.03 |
| 3,954,038 | 5/1976 | Adams | 84/1.03 |
| 4,046,047 | 9/1977 | Roberts | 84/1.03 |

*Primary Examiner*—Edith S. Jackmon

[57] ABSTRACT

The present invention is an arpeggio system for use in a musical instrument having a multiplexed keyboard, wherein operated playing keys are represented by cyclic pulses in corresponding time slots in a serial time division multiplex data format, connected over a single bus to a multiplexed pitch generator system for producing tones at pitches corresponding to the time slots in the serial data stream in which the cyclic pulses representing operated playing keys appear. The arpeggio system is connected in the serial data path in repeater fashion so as to be operated under control of the serial data stream received from the keyboard to selectively retransmit cyclic pulses in the serial time division multiplex data format to the pitch generator system. Two sequences are provided in the arpeggio system, one is operated in response to received multiplex signals representing a sustained chord to transmit multiplex signals representing individual notes of the chord played in ascending sequence and the other is operated upon completion of the ascending note sequence to shift the received signals by a time interval corresponding to an octave; whereby repeated operations of the two sequencing circuits generate multiplexed output signals representing a multi-octave arpeggio sequence of notes. Strum and up-down arpeggio modes are also provided for.

4 Claims, 2 Drawing Figures

AUTOMATIC ARPEGGIO FOR MULTIPLEXED KEYBOARD

BACKGROUND OF THE INVENTION

A number of arpeggio systems have been described heretofore. Examples are the Kniepkamp U.S. Pat. No. 3,842,184; Deutsch U.S. Pat. No. 3,854,366; and Adams U.S. Pat. No. 3,954,038. In all of these systems the input intelligence representing operated keys of a keyboard is presented to the arpeggio system in parallel form. The parallel registration is scanned rapidly until an operated key is identified, then the scanner is halted while the required note is sounded by selecting a corresponding keyer from a parallel array of 36 or more keyers, and after the desired note duration time has expired scanning is resumed. The large number of connections required in such systems is a severe limitation when it is desired to implement the circuits in LSI form.

Organs have been described which economize on hardware and wiring complexity by using multiplexed keyboards to control multi-pitch note generators over a single time division multiplexed signal buss. The arpeggio system described herein is specifically intended for use in such systems. A co-pending patent application entitled "Electronic Organ With Multiple Pitch Note Generators", Ser. No. 610,773, now U.S. Pat. No. 4,038,896 filed Sept. 5, 1975, describes an electronic organ with a modified keyboard and special interface circuitry arranged to multiplex signals generated by operation of playing keys on a single buss to facilitate implementation of note generators in LSI form. The circuitry of this multiplexed keyboard is repeated in the present disclosure. Alternative forms of multiplexed keyboards are shown in the Deutsch U.S. Pat. No. 3,696,661 and in Kmetz U.S. Pat. No. 3,875,842.

SUMMARY OF THE INVENTION

The heart of the invention is an automatic sequencer that is interposed in a multiplexed signal path between a keyboard and a multi-pitch note generator, or a set of polyphonic note generators, and control circuitry responsive to multiplexed signals produced by the continuous operation of a group of playing keys to cause the sequencer to produce multiplexed signals corresponding to strumming of a chord corresponding to the operated keys. The invention also provides control circuits for shifting the octave interval timing signals supplied to the keyboard, relative to the signals supplied to the note generators, at appropriate times to cause the strummed chord to be repeated at successively higher octave intervals to produce an upscale arpeggio extending to the top of the keyboard's range and then, if desired, to reverse the sequence to produce a downscale arpeggio back to the starting point. No modification of the keyboard or the note generators is necessary to accomplish these added features, hence they can readily be provided as an optional feature to an organ very economically.

DESCRIPTION OF A PREFERRED EMBODIMENT OF THE INVENTION

Keyboard and Interface Circuits

Figure 1:
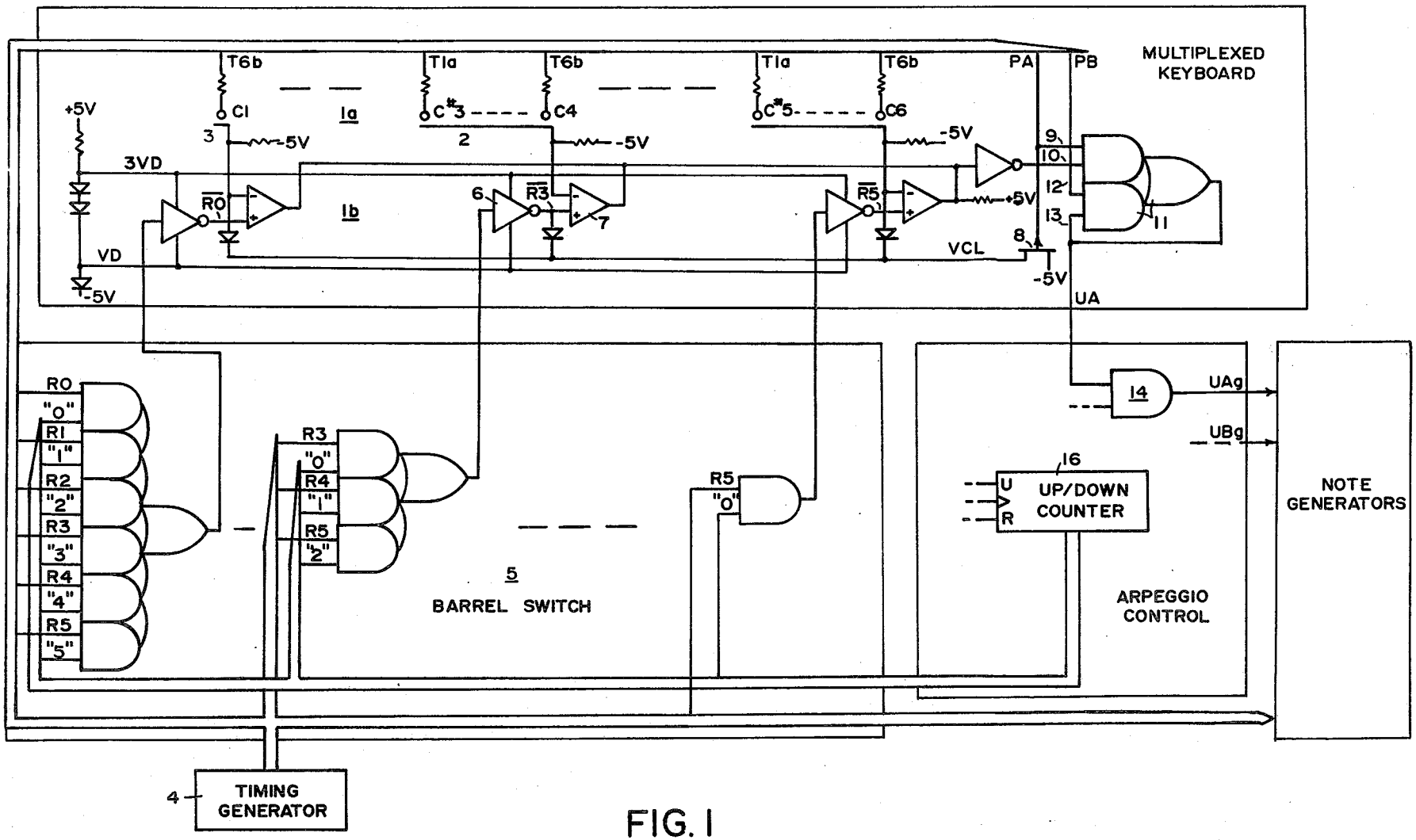
FIG. 1 is a schematic diagram of one form of multiplexed keyboard and a barrel switch for shifting the octave interval timing signals together with a skeletonized schematic of the arpeggio control and a block representation of the note generators.

The keyboard proper 1*a* is shown in FIG. 1 along with the interface circuitry 1*b* that converts keyswitch closures into multiplexed signals on output buss UA. This is the same type of keyboard and interface circuitry as that shown in the co-pending application cited above. Another source of multiplexed signals that may be used with the invention is shown in another co-pending application entitled "Hand Held Synthesizer", Ser. No. 675,835 filed Apr. 12, 1976 which is a non abandoned . This alternative source comprises a set of three playing keys that are operated combinatorially to select a root note and a set of chord buttons that are operated individually to select a chord based on the selected root note. The resistors shown in series with the movable key contacts provide isolation between timing sources when several keys are operated concurrently. They can have a value of 100 K ohms, but it is not critical. Separate collector busses, such as 2, are provided for each octave. A short collector buss 3 is provided for the first note C1. The ends of the resistors away from the movable contacts are paralleled with the corresponding resistors in other octaves to twelve leads, T1*a*–T6*b*, from the timing generator 4. Thus all C# contacts are connected through resistors to T1*a*, all D contacts are connected to T1*b*, etc.

Timing Generator

The timing generator 4 operates at an internal 200 khz clock rate to produce five pulse trains, including PA and PB shown at the upper right in FIG. 1, all having repetition rates of 25 khz and having the duty cycles and time relationships depicted in FIG. 3*a* of the aforementioned co-pending application, Ser. No. 610,773, now U.S. Pat. No. 4,038,896. These pulse trains can readily be produced using an eight state Johnson counter. A second Johnson counter, having six states, can be used to produce six pulse trains T1–T6, all having a nominal duty cycle of 1/6 with a nominal period of 480 μs, and having the nominal time relationship shown in FIG. 3*b* of the above cited application. The RO pulse train is provided to accommodate the odd note C1, hence it is made shorter than the others. By making it equal in width to four note time slots, or 160 μs, certain recycling operations described later are facilitated. The pulse train TA coincides with the first half of each of the timing pulses T1–T6, whereby twelve time slots, T1*a*, T1*b*, T2*a*–T6*b*, corresponding to the twelve notes of the equal tempered musical scale, are obtained. These twelve pulse trains extend to corresponding note keys of the keyboard 1*a*. Each of the R1–R5 pulse coincides with one full cycle of the twelve pulses T1*a*–T6*b*, whereby each key of a 61–72 note keyboard can be identified by a pair of T1*a*–T6*b* and RO–R5 pulses.

Multiplex Operation

Leads RO–R5 from the timing generator 4 are connected to the barrel switch 5 having its outputs connected to level shifting inverters, such as 6, to obtain outputs $\overline{RO}$–$\overline{R5}$ which swing sequentially from three diode drops above −5 V (3 VD) to one diode drop above −5 V (VD). The normal levels for all logic signals are +5 V for high, or true, and −5 V for low, or false. These outputs are connected to corresponding inputs of comparators, such as 7, associated with each of the collector busses, such as 2, whereby these busses are scanned sequentially from the low to the high end of the keyboard. Since the individual notes associated with each buss are scanned sequentially from C#-C by the T1*a*–T6*b* timing signals, the combined effect is to scan the entire keyboard from bottom to top.

It should be understood that the use of a barrel switch to shift the octave interval timing signals, relative to the multiplex frame, is shown by way of example only. Alternatively, a shift register may be provided in which a single one, or a single transistion from "0" to "1", is shifted to cause the octave interval timing signals R0–R5 to become true sequentially one at a time. By varying the point in the multiplex frame at which the shift operation commences, the octave interval timing signals may be shifted in the desired manner. The barrel switch is simpler to describe and is also preferred because it uses fewer components.

Depression of a key, such as C4, causes the corresponding collector buss, such as 2, to rise from −5 V to one diode drop above −5 V during the major portion of the corresponding time period, such as T6*b*. During the 5 μs strobe portion (PA) of this time period the buss will rise two diode drops since the JFET 8 which normally shunts lead VCL to −5 V is cut-off during the strobe pulse. The comparator 7 is unaffected by the signal at its inverting input except during the period when $\overline{R3}$ lowers its non-inverting input from 3 VD to VD. During this interval, the comparator 7 drives its output to −5 V for the duration of the PA pulse, at least, causing coincident high logic level signals to appear at inputs 9 and 10 of AND-OR select gate 11. The comparators, such as 7, have dedicated collector type outputs. Gate 11 latches its output UA to pulse PB via its inputs 12 and 13 to insure an output pulse duration of at least 25 μs.

At the end of the strobe pulse, VCL is again clamped to −5 V by JFET 8 to restore the buss 2 to one diode drop above −5 V so that it will be restored quickly towards −5 V at the end of the T6*b* pulse.

Figure 2:
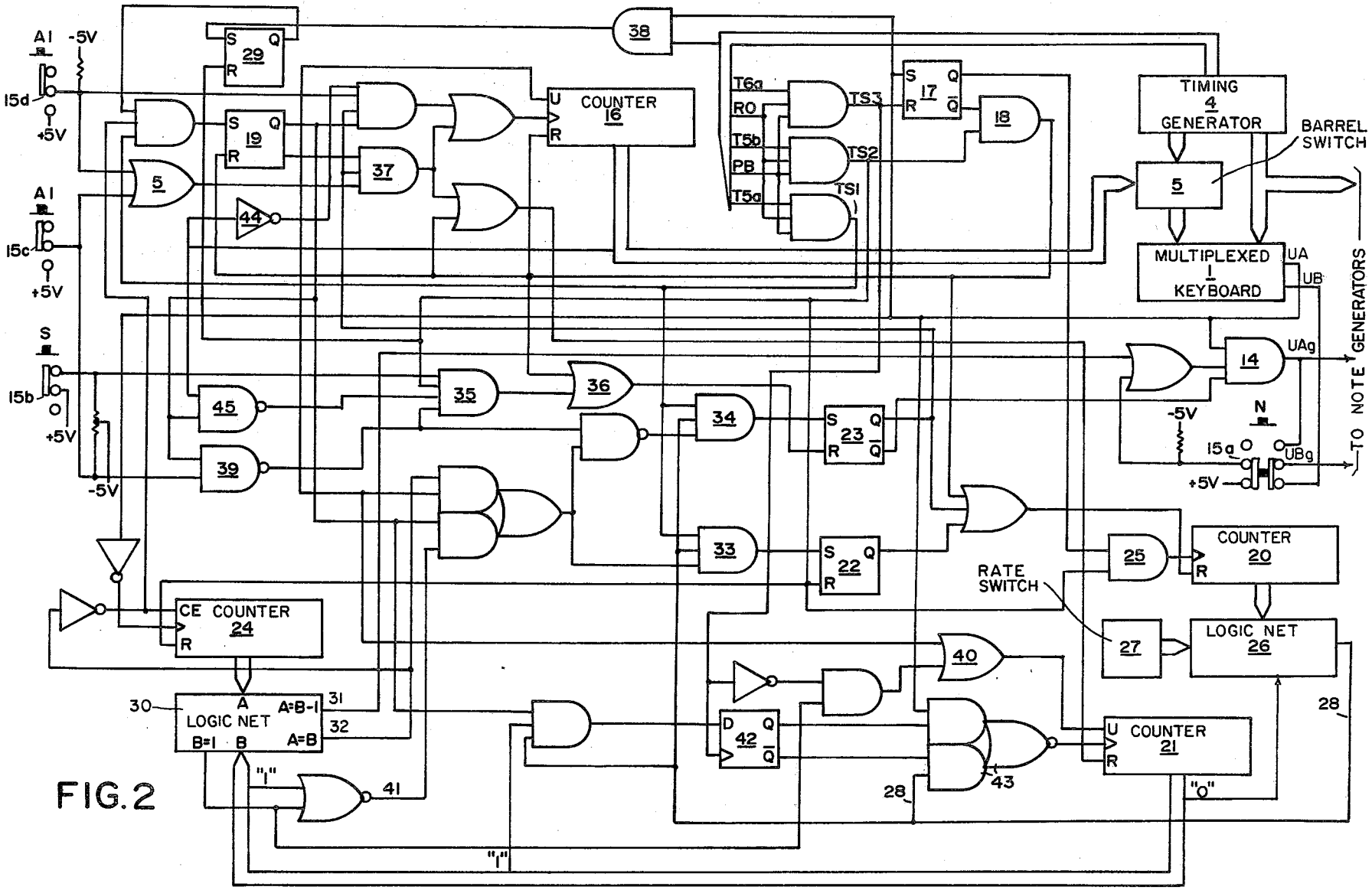
FIG. 2 is a detailed schematic diagram of the arpeggio control shown in skeletonized form in FIG. 1.

The 25 μs minimum duration output pulse on UA is repeated every 2.56 ms as long as the C4 key is held down. All such pulses are transmitted through gate 14 in the arpeggio control to the note generators when the mode selector switch 15; shown in FIG. 2, is set to NORMAL. The up/down counter 16 remains in the "0" state in the NORMAL mode causing a one-to-one correspondence to exist between the RO–R5 outputs of the timing generator 4 and the $\overline{RO}$–$\overline{R5}$ inputs to the comparators, such as 7, of the multiplexed keyboard 1.

Automatic Strum Mode

The operation of the arpeggio control in the strum mode will now be explained with reference to FIG. 2. The mode selector switch 15 is shown set to the NORMAL mode. This switch is preferably a four button interlocked type. Thus when the STRUM mode is selected by operating switch section 15*b*, the 15*a* section is released. This disconnects the UBg lead from the UB output of the multiplexed keyboard 1 and connects it in parallel with the UAg output of the arpeggio control. The UB input of the note generators described in the above cited application is associated with a touch responsive feature that is not used in the automatic arpeggio mode of operation.

To begin with, it should first be noted that flip-flop 17 insures that a number of circuits are reset whenever no keyswitches are operated. This is accomplished as follows. 17 is reset at TS3 time, which is the third time slot T6*a*.RO of the 64 slots in the multiplex time frame. If no keyswitches are operated, there is no true signal on buss UA at any point in the frame, hence during TS2 time, which is the second time slot T5*b*.RO in the next frame, the output of gate 18 is true, resetting flip-flop 19, up/-down counter 16, and counters 20 and 21; if they are not already reset. It may be noted at this point that flip-flop 22 and counter 24 are reset at this time slot in every frame, regardless of the keyboard state.

If, on the other hand, a key is depressed; then 17 is true during TS2 time, causing the output of gate 25 to transmit a pulse to the clock input of binary counter 20 at this time. Counter 20 is thus advanced one count every 2.56 ms. Since the function performed by 20 is non-critical timing of the rate at which notes are played, the counting period is rounded down to 2.5 ms in the following for simplicity. A slightly different function is performed by 20 initially, that is to provide a delay from the time that the first depressed key is detected before sounding any note to insure that the first note sounded is the lowest note of the chord that the player intends to have strummed.

The outputs of counter 20 are decoded by a logic net 26 to provide true signals on separate leads after 10, 40, 60, 80, 120, 160, 240, 320, and 480 ms. The 10 ms delay signal is selected by the "0" output of counter 21 and is OR'ed with one of the other eight delay signals selected by the combinatorial state of three leads from the rate switch 27. When the 10 ms delay signal appears on output lead 28 it allows the output of gate 33 to become true during the first time slot TS1=T5.RO of the next frame to set flip-flop 22 which resets counter 20. Counter 21 is advanced to "1" when output 28 goes low. Consequently, the A=B−1 output 31 of logic net 30 becomes true and, since flip-flop 23 is in its false state, gate 14 is enabled to transmit the next pulse on UA to UAg. Upon the expiration of that next pulse, counter 24 is advanced to "1", making output 31 low to disable gate 14 and prevent further transmission of pulses to UAg for the remainder of the frame. Output 32 being made true prevents further advancement of counter 24, which is reset at the start of the next frame, causing the cycle to repeat and send one pulse to UAg in each frame. When the delay selected by the rate switch 27 has expired, the resulting true outputs on 28 and 32 of nets 26 and 30, respectively, causes flip-flop 22 to be set by the output of gate 33 in the time slot TS1 of the next frame. Counter 20 is immediately reset by 22, which is in turn reset in the next time slot TS2. Counter 21 advances to "2" when counter 20 is reset. The cycle of operations described above is now repeated, except that this time a pulse corresponding to the second lowest note of the selected chord is repeated by gate 14 to buss UAg in each frame.

Each time that the chosen delay expires the next higher note of the selected chord is sounded under control of counter 21 until it reaches a count greater than the number of notes in the selected chord. When this happens output 32 remains low through the first time slot, causing gate 34 to go true, instead of gate 33, setting flip-flop 23 which inhibits gate 14 and maintains counter 20 reset until the playing keys are released.

Arpeggio Up Mode

Operation of switch 15*c* enables gate 37 so that up/-down counter 16 will be advanced one count when flip-flop 23 is set following the first strum cycle. Counter 21 is reset by the output of gate 37 at the same time that 16 is advanced. Since gate 35 is enabled by the mechanical release of switch 15*b*, flip-flop 23 is reset during the second time slot TS2 and the strum cycle of operations is repeated, only this time the notes are sounded one octave higher because the advancement of counter 16 to the "1" count causes the barrel switch 5 to parallel shift the octave interval timing signals RO–R5 one place to the left (see FIG. 1). This action is repeated at the completion of each strum cycle until one or more of the notes in the chord appear in the top octave, i.e. C♯5–C6 (see FIG. 1). When this occurs gate 38 sets flip-flop 29 when the pulse on UA corresponding to the highest note in the chord appears at R5 time. Flip-flop 19 is consequently set at TS1 time following completion of the last strum cycle. Both inputs of gate 39 are now true, hence gate 35 is inhibited from resetting flip-flop 23 when it subsequently is set upon expiration of the chosen delay time. Further sounding of any notes is thus prevented because flip-flop 23 inhibits gate 14 and maintains counter 20 reset until the operated keys are released.

Arpeggio Up/Down Mode

The first half of the arpeggio up/down operations is identical to that just described for arpeggio up operations. The U input of counter 21 becomes low when flip-flop 19 is set, after the last note of the arpeggio up operations is sounded, therefore counter 21 backs down one count when counter 20 is reset. This avoids repetition of the top note during the downscale arpeggio.

With flip-flip 19 set true, control over the setting of flip-flop 22 and 23 is transferred from output 32 of net 30 to the inverted "1" output of counter 21 on lead 41. Assuming that a chord of two or more notes is being played, lead 41 is true at this time causing flip-flop 22 to be set at TS1 time. Counter 20 is reset by 22 and counter 21 backs down one count, as mentioned previously. During the succeeding frames the second from the top note of the selected chord is sounded until the chosen delay time expires, causing output 28 to become true. Flip-flop 22 is again set at TS1 time, resetting counter 20 which causes counter 21 to back down another count. The third note from the top of the chord is now sounded.

The above cycle of operations continues until counter 21 is backed down to the count of "1". When the net 26 output 28 again becomes true it makes the D input of flip-flop 42 high, causing it to be clocked true at TS3 time. The clock input of counter 21 is transferred from lead 28 to buss UA by AND-OR select gate 43 causing counter 21 to back down to "0", but without effect because the true output of flip-flop 42 forces a "1" into the B value internal to the net 30 and also forces lead 41 low. The U input of counter 21 becomes high at the end of TS3 time, hence it is advanced one count for each pulse on UA during this final frame for the top octave chord. The final count is the number of notes in the selected chord. At TS1 time in the next frame flip-flop 23 is set causing counter 16 to back down one count and resetting counter 20. Flip-flop 23 is reset in the next time slot and flip-flop 42 is clocked false by TS3. The top note of the selected chord is now sounded on octave lower. With 42 false, counter 21 again backs down one count at the end of each delay period to select the next lower note of the chord.

The above cycle of operations is repeated until the lowest note of the chord has been sounded at its normal pitch. After the chosen delay has expired, flip-flop 23 is set as usual, but counter 16 is prevented from counting down further by inverter 44 and gate 45 inhibits gate 35 to prevent the release of flip-flop 23, hence gate 14 is inhibited and counter 20 is maintained released. When the operated keys are released flip-flop 17 remains false at TS2 time causing gate 18 to restore all circuits to normal, as described previously.

Implementation.

The circuits described do not place any severe requirements on the semiconductor technology used for its implementation; hence the choice may be made on the basis of cost and compatibility of external circuits they are to interface with. The arpeggio control, including the barrel switch, employs aproximately 1030 transistors. The timing generator employs approximately 360 transistors. Both of these functions can readily be fabricated on a single chip with approximately 1400 transistors, which is a very small by current LSI standards. In production quantities the cost would be less than $5 at the present time.

Although the invention has been described and illustrated in detail, it is to be understood that the same is by way of illustration and examle only, and it is not to be taken by way of limitation. The spirit and scope of the invention is limited only by the terms of the appended claims.

I claim:

1. In a musical instrument of the type including a multiplexed keyboard and a multiplexed note generator system connected by a serial signal line to identify operated playing keys, an arpeggio system connected in circuit with the serial signal line and including a gating circuit operative cyclically at multiplex rate to pass a selected one of several multiplexed signals from a source in a group appearing on the serial signal line while blocking the remainder, and an automatic sequencing circuit operated to control said gating circuit in response to receipt of a multiplexed signal identifying a chord to selectively pass the multiplexed signals representing individual notes of the chord in ascending sequence.

2. A musical instrument as claimed in claim 1 including a second sequencing circuit operated in response to completion of the ascending note sequence to shift multiplexed signals by a time interval corresponding to an octave, whereby repeated operations of said sequencing circuits transmits multiplexed signals representing a multi-octave arpeggio sequence of notes.

3. A musical instrument as claimed in claim 1 including a second sequencing circuit operated upon completion of the ascending note sequence to modify the signals produced by said source so as to represent the same chord pitched one octave higher, whereby repeated operation of said sequencing circuits generates multiplexed signals representing a multi-octave arpeggio sequence of notes.

4. A musical instrument as claimed in Claim 1 including a second sequencing circuit operated upon completion of the ascending note sequence to shift the multiplexed signals from a source by a time interval corresponding to an octave, whereby repeated operations of said sequencing circuits generates multiplexed signals representing a multi-octave sequences of notes.

* * * * *